US008652743B2

(12) United States Patent
Tyagi et al.

(10) Patent No.: US 8,652,743 B2
(45) **Date of Patent: *Feb. 18, 2014**

(54) RAISED PRINTING USING SMALL TONER PARTICLES

(75) Inventors: Dinesh Tyagi, Fairport, NY (US); Louise Granica, Victor, NY (US); Thomas N. Tombs, Rochester, NY (US); Donald S. Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 128 days.

This patent is subject to a terminal disclaimer.

(21) Appl. No.: 12/707,873

(22) Filed: Feb. 18, 2010

(65) Prior Publication Data

US 2011/0200933 A1 Aug. 18, 2011

(51) Int. Cl.
*G03G 13/14* (2006.01)

(52) U.S. Cl.
USPC ..... 430/126.1; 430/120.1; 430/124.21; 430/124.3

(58) Field of Classification Search
USPC ..... 430/124.21, 124.3, 120.1, 126.1
See application file for complete search history.

(56) References Cited

U.S. PATENT DOCUMENTS

| | | | | |
|---|---|---|---|---|
| 4,336,546 | A | 6/1982 | Edwards et al. | |
| 5,834,150 | A * | 11/1998 | Brennan et al. | 430/109.3 |
| 2005/0135851 | A1 | 6/2005 | Ng et al. | |
| 2008/0159786 | A1 | 7/2008 | Tombs et al. | |
| 2008/0298860 | A1 * | 12/2008 | Omata | 399/321 |
| 2009/0016757 | A1 * | 1/2009 | Priebe et al. | 399/58 |
| 2011/0200932 | A1 * | 8/2011 | Tyagi et al. | 430/124.1 |

* cited by examiner

*Primary Examiner* — Peter Vajda
(74) *Attorney, Agent, or Firm* — David A. Novaks; Roland R. Schendler, II

(57) ABSTRACT

Electrophotographic printing of one or more layers of toner to enable the printing of a wide range of toner mass laydown using electrophotography to produce prints with raised letters. This method encompasses the steps of forming multicolor toner images and fusing the print one or more times to create the raised print having the desired height of raised print.

12 Claims, 5 Drawing Sheets

RAISED PRINTING USING SMALL TONER PARTICLES

CROSS REFERENCE TO RELATED APPLICATIONS

This application relates to commonly assigned, copending U.S. application Ser. No. 12/707,877 filed Feb. 18, 2010, entitled: "A SYSTEM TO PRINT RAISED PRINTING USING SMALL TONER PARTICLES" and U.S. application Ser. No. 12/707,861 filed Feb. 18, 2010, entitled: "RAISED LETTER PRINTING USING LARGE YELLOW TONER PARTICLES", hereby incorporated by reference.

FIELD OF INVENTION

This invention relates to a method of producing documents with raised letters using dry electrophotographic technology. More specifically, this method describes a method and apparatus for producing documents with raised letters having a tactile feel using toner particles.

BACKGROUND OF THE INVENTION

In an electrophotographic engine, a primary imaging member (PIM) such as a photoreceptive member, often referred to as a photoconductor, is initially uniformly charged by known means such as a grid controlled AC or DC corona charger, a roller charger, or other known means. An electrostatic latent image is then formed on the PIM by image-wise exposing the PIM to light, using known means such as laser scanners, LED arrays, or optical exposure. The electrostatic latent image is then converted into a visible image by bringing the PIM into close proximity with a development station containing a developer. The developer may contain toner particles that contain a colorant and are known as marking particles. Alternatively, the toner particles may lack colorant and be known as clear toner. Some typical present day toner particles have a volume-weighted diameter of between 4 μm and 9 μm. In addition, some toner particles often are coated with nanometer-size clusters of particulate addenda such as $SiO_2$, $TiO_2$, etc. Such addenda improve flow and transfer by reducing adhesion and also help to control the charge of the toner particles. The developer frequently contains carrier particles that are known to be used in so-called two component developers. Such developers lack solvent such as various hydrocarbons or silicones and are generally referred to as dry developers and the process of developing the toner image referred to as dry electrophotographic development. The carrier particles are often magnetic particles and serve to transport the toner particles using magnets in the development station. The carrier particles also serve to impart a controlled charge on the toner particles through triboelectrification. This charge allows the particles to be attracted to and thus develop the electrostatic latent image. The charge also allows the toner particles to be transferred to another substrate such as a transfer intermediate member or a receiver such as paper.

After development, the visible or toner image is transferred to a receiver. This is generally accomplished by subjecting the electrically charged toner particles to an electrostatic field that urges the particles towards the receiver while bringing the receiver into contact with the toner particles.

In many instances, the toner image is transferred directly to a receiver such as paper. The image is then permanently fixed to the receiver. This is generally accomplished by subjecting the image-bearing receiver to a combination of heat and pressure, although alternative methods such as employing the use of microwave or RF electromagnetic radiation, radiant heat, solvent vapors, etc. are occasionally employed. After transfer, the PIM is cleaned and made ready for subsequent imaging.

To produce color prints, electrostatic latent images corresponding to specific color information are first produced on the PIM. These generally correspond to the subtractive primary colors, cyan, magenta, yellow, and black. The separate electrostatic images are made visible by bringing the PIM into close proximity to a development station containing toner of the appropriate color. The images are then transferred to a receiver, in register, generally by pressing the receiver in contact with the PIM under an applied electrostatic field repeatedly until each of the subtractive primary toner images has been transferred. The image is then fixed to the receiver, generally upon application of heat and pressure.

In some instances it is preferable to first transfer the toner image or images to one or more transfer intermediate members, especially compliant transfer intermediate members. In one embodiment of such, each color image is transferred to a separate intermediate member. The images are then transferred in register, sequentially, to the receiver. In an alternative embodiment, the images are transferred in register to the intermediate transfer member (ITM) and then the registered toner image is transferred to the receiver. In both cases, the toner transfer is accomplished by first pressing the ITM into contact with the PIM while applying an electrostatic field to urge the toner to the ITM. The receiver is then pressed against the ITM and an electrostatic field exerted to urge the toner image from the ITM to the receiver.

In order to maintain image quality such as low levels of granularity and high resolution, it is desirable to use small toner particles. For dry electrophotographic developers, small toner particles typically have diameters between 5 μm and 9 μm. Unless otherwise noted, the term toner diameter refers to the volume-weighted diameter of toner, as measured with a Coulter Multisizer or comparable device. Smaller toner particles are difficult to transfer and have restricted flow properties. Larger toner particles create high granularity and reduce resolution.

It is possible to produce desirable graphic arts effects using raised letters without degrading image quality by using large clear toner particles. However, the use of clear toner would require that the electrophotographic engine being used have more than the four development stations required for a regular subtractive primary color printer and if one of the primary color stations were removed and large clear toner substituted in that particular station that would degrade the ability of the printer to produce high quality color prints spanning the color gamut.

It is clear that a new process that does not rely on the presence of large clear toner is needed to produce raised print with compact printers, such as an engine containing four or fewer development stations. This invention discloses a method and apparatus capable of meeting these needs.

SUMMARY OF THE INVENTION

It is an objective of this invention to describe a method and related apparatus capable of producing prints with raised letters without requiring that the electrophotographic engine have more than four development stations. A further objective is to describe a method and apparatus that can also be used in electrophotographic engines that have more than four development stations, but in which the use of large color toner is not successful.

The printer of this invention can produce prints having raised letter printing where the raised letter height is in excess of 100 μm and even more, such as 200 μm. For the purpose of this invention, the term raised letter refers to any indicia such as an alphanumeric character, a solid shape, or any shape consisting of line art whereby the fused lines or characters or shapes or portions thereof are to exhibit significant relief over and above the plane of the substrate.

The described method can also print an image that is developed onto a primary imaging member and transferred to an electrically conducting, preferably grounded, substrate. In this method the charges on an image is opposite the charge on the toner in the development station. The image is then brought back into close proximity to the development station so that additional toner could be deposited onto the previously toned image. It is important that the potential of both the conductive substrate and the toning station are sufficiently close to each other so no that toner is deposited into the untoned regions. In one embodiment, the potentials are the same and, both are grounded. After toning, the image is again fixed and the process repeated until sufficient image height is obtained.

DETAILED DESCRIPTION OF THE INVENTION

Figure 1:
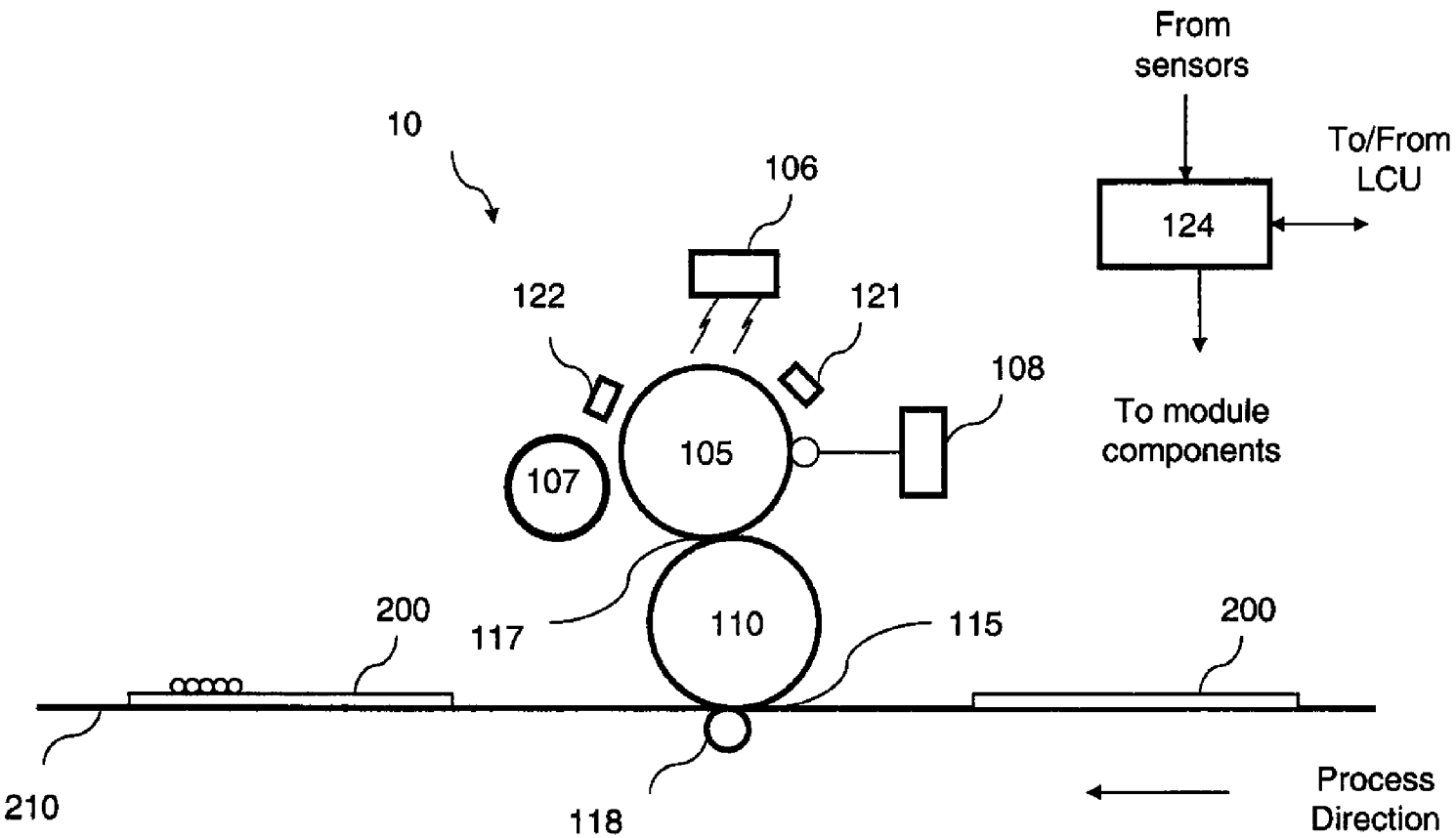
FIG. 1 is a schematic diagram illustrating an electrographic printing module for use with the present invention.

An electrographic printing method can form raised information on a receiver member by forming a print image electrographically on a receiver member using standard sized marking particles before forming a first image electrographically on one or more first selected areas of the print image on the receiver using normal size marking particles (e.g. those with volume-weighted diameters of between approximately 5 μm and 12 μm. Then the image is transferred to a receiver and fixed using either thermal fixing employing known means such as applying heat, heat and pressure, microwave, RF, or solvent vapors, to the image. In one embodiment of this invention, a second, image corresponding to the portion of the image that is to be raised is then developed and transferred to the receiver and fixed. The process is repeated until the desired image height is obtained. If the image height is to be varied, the amount of toner developed and transferred to the receiver can be appropriately adjusted. Thus, if a scene depicting, for example, mountains and valleys is to be printed, variable texture can be obtained by varying the amount of toner deposited onto the primary imaging member and transferred to the receiver. To maintain proper color balance, the toner variations can occur for each color. Thus, the ruggedness of a mountain can be printed while maintaining color fidelity.

This gives the improved print image quality that print providers and customers have been looking for to expand the use of electrographically produced prints. In certain classes of printing, a tactile feel to the print is considered to be highly desirable. These include the ultra-high quality printing, such as printing for stationary headers or business cards which utilizes raised letter printing to give a tactile feel to the resultant print output. For many of these printing applications, in order to directly replace the standard, and more expensive, engraving, embossing, or thermographic processes, it is highly desirable to produce a raised letter height of 50 μm or greater. Other instances where tactile feel in the print would be desirable are Braille prints or print documents having security features provided there within. Presently, the minimum height recommended for Braille prints is 200 μm.

In co-pending patent application U.S. Ser. No. 12/707,877, a method for producing prints with raised letters using large, clear toner particles is described. The present invention describes a method and apparatus for producing prints with raised letters that does not require colorless toners, large toner particles, or an apparatus having one or more development stations dedicated for applying such toners. Accordingly, the invention is directed to an electrographic printing of raised images to selected areas of a receiver member using electrographic techniques so that resulting image made from two different sized toner particles has a raised print height of 40 μm and greater.

U.S. Patent Application Publication No. 2008/0159786, which is incorporated by reference, describes the use of a fifth color module in an electrophotographic printing process for depositing a high mass laydown (≥2 mg/cm$^2$) of a large clear toner particle alongside standard, smaller sized, pigmented toner particles for producing a high quality print having tactile feel. However, due to limitations such as toner size due to the manufacturing process—typical processes limit toner size average diameter to roughly 30 μm, and the development step in the electrophotographic process which limits the mass laydown to roughly a double layer of clear toner, the maximum raised letter height for a rich black text at 320% laydown for 8 μm pigmented toner plus the large clear toner is less than 40 μm. This falls short of the 50 μm height desired for directly replacing thermographically produced prints and falls far short of the 200 μm recommended height for Braille prints. In addition, achieving a ground toner size of 30 μm or greater creates significant manufacturing challenges and additional costs due to changing to a non-standard air nozzle for grinding (—manufacturing inefficiency), and an extra size classifying step.

The present invention can be used to produce raised letter prints or other images having visible and/or tactile relief produced by dry electrophotographic engines. This system and related method is particularly well suited for making raised letter prints with electrophotographic development stations having four or fewer development stations in which the marking particles have diameters between 4 μm and 9 μm, preferably between 5 μm and 8 μm. This system and related method is also particularly well suited to produce raised letter prints or other images having tactile or visible relief using dry electrophotographic development engines that include a development station containing clear or nonmarking toner particles having diameters between 12 μm and 50 μm, and preferably between 20 μm and 50 μm. For purposes of this invention, an electrophotographic development engine is considered to be dry if at least one development station uses dry electrophotographic developer, such as an electrophotographic developer in which the marking or nonmarking toner particles are not dispersed or dissolved in a liquid solvent. Examples of dry development engines include those that contain two-component developers and employ magnetic development stations such as those that employ either fixed or rotating magnetic cores.

In order to understand some of the complexities limiting previous attempts to create prints with relief a review of a paper by Wright et al. (J. Image. Sci. Technol. 49, 531-538 (2005)), shows that transferring toner across an air gap is quite problematical. Specifically, the magnitude of the electric field that can be applied and, accordingly, the electrostatic force that can be exerted to transfer the toner particles across an air gap, which is equal to the charge on the toner particle times the applied electrostatic field, is limited by the Paschen discharge limit of air. The Paschen discharge limit varies inversely with the size of the air gap and is approximately equal to 35 V/μm for a 10 μm wide air gap and decreases to approximately 5 V/μm for air gaps in excess of 100 μm wide. As discussed by Rimai et al. (J. Adhesion Sci. Technol.). A typical charge on a toner particle of the size used in this specification is approximately $10^{-14}$ C. Thus, the electrostatic force applied to transfer such a particle would be, at most, 350 nN for a 10 μm wide air gap and 50 nN for 100 μm wide air gaps. As further discussed by Rimai et al. in the previously cited reference, the force needed to remove a normally charged toner particle having nm clusters of silica particulate addenda coating the surface of the toner particle is approximately 100 nN. Therefore, it would simply not be feasible to transfer toner particles across large air gaps. Furthermore, as also discussed in Rimai et al. simply increasing the toner charge would not be feasible as it would increase toner adhesion to the PIM, thereby making transfer across an air gap even more difficult. In addition, increasing the toner charge would also limit the optical density of the image formed on the PIM. The initial potential on the PIM also cannot be arbitrarily increased due to the occurrence of breakdown due to the high fields on the PIM.

Figure 2:
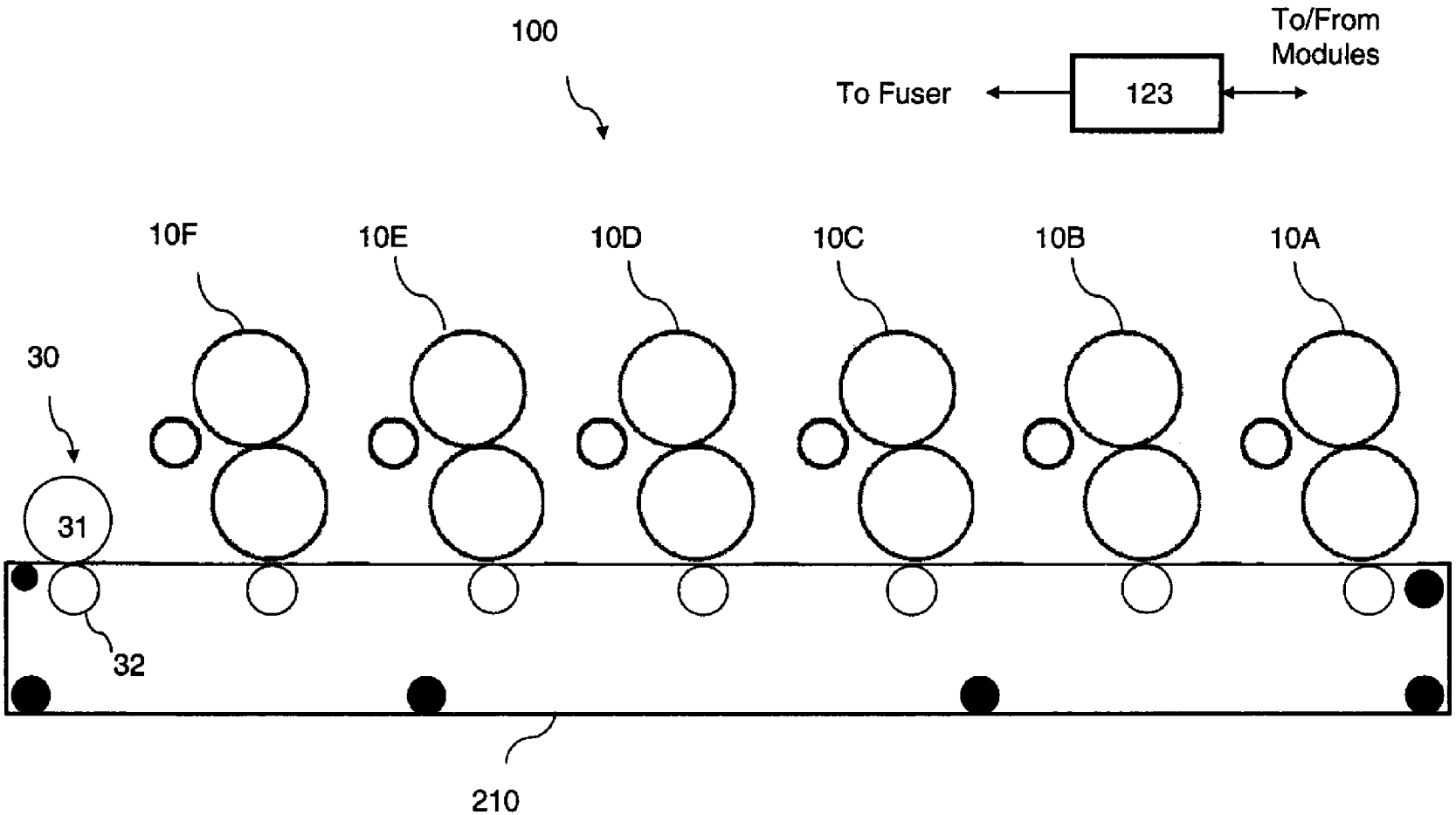
FIG. 2 is a schematic diagram illustrating an electrographic printing engine employing printing modules as illustrated in FIG. 1 for use with the present invention.

Referring now to the accompanying drawings, FIGS. 1 and 2 schematically illustrate an electrographic printer engine according to embodiments of the current invention. Although the illustrated embodiment of the invention involves an electrographic apparatus employing six image producing print modules arranged therein for printing onto individual receiver members, the invention can be employed with either fewer or more than six modules. The invention may be practiced with other types of electrographic modules.

The electrographic printer engine 100 has a series of electrographic printing modules 10A, 10B, 10C, 10D, 10E, and 10F. As discussed below, each of the printing modules forms an electrostatic image, employs a developer having a carrier and toner particles to develop the electrostatic image, and transfers a developed image to a receiver member 200. Where the toner particles of the developer are pigmented, the toner particles are also referred to as "marking particles." The receiver member may be a sheet of paper, cardboard, plastic, or other material to which it is desired to print an image or a predefined pattern. In one embodiment of the invention (not shown) a fusing module is interspaced between at least two of the printing modules.

The electrographic printing module 10 shown in FIG. 1 is representative of each of the electrographic printing modules 10A-10F of the electrographic printing engine 100 shown in FIG. 2. The electrographic printing module 10 includes a plurality of electrophotographic imaging subsystems for producing one or more multilayered image or shape. Included in each printing module is a primary charging subsystem 108 for uniformly electrostatically charging a surface of a photoconductive imaging member (shown in the form of an imaging cylinder 105). An exposure subsystem 106 is provided for image-wise modulating the uniform electrostatic charge by exposing the photoconductive imaging member to form a latent electrostatic multi-layer (separation) image of the respective layers. A development station subsystem 107 is provided developing the image-wise exposed photoconductive imaging member. An intermediate transfer member 110 is provided for transferring the respective layer (separation) image from the photoconductive imaging member through a first transfer nip 117 to the surface of the intermediate transfer member 110 and from the intermediate transfer member 110 through a second transfer nip 115 to a receiver member 200.

The embodiment of an electrographic printing engine shown in FIG. 2 employs six electrostatic printer modules 10A, 10B, 10C, 10D, 10E, and 10F each of which has the structure of the electrostatic printer module 10 illustrated in FIG. 1. Each of the printing modules is capable of applying a single color, transferable image to receiver members 200. The transport belt 210 transports the receiver member 200 for processing by the printing engine 100. As the receiver member 200 moves sequentially through the printing nips of the electrostatic printer modules 10A, 10B, 10C, 10D, 10E, and 10F, the printing modules successively transfer the generated, developed images onto the receiving member in a single pass.

The illustrated printing engine 100 includes six electrostatic printing modules, and accordingly up to six images can be formed on a receiver member in one pass. For example, printing modules 10A, 10B, 10C, and 10D can be driven with image information to form black, yellow, magenta, and cyan, images, respectively. As is known in the art, a spectrum of colors can be produced by combining the primary colors cyan, magenta, yellow, and black, and subsets thereof in various combinations. The developer in the development station of printing modules 10A, 10B, 10C, and 10D employs pigmented marking particles of the respective color corresponding to the color of the image to be applied by a respective printing module. The remaining two modules, 10E and 10F, are provided with marking particles having alternate colors to provide improved color gamut, non-pigmented particles to provide clear layer protection glossy print capability, or some combination thereof. For example, the fifth electrostatic module is provided with developer having red pigmented marking particles and the sixth electrostatic module is provided with developer having non-pigmented particles. Alternatively, if the raised printing is to be of a single color such as black, a fusing module is placed between modules 10D and 10E and between modules 10E and 10F. These print modules are configured to print black, thereby allowing multiple black images to be printed in register, thereby creating a raised print. If only some of the black lettering is to be raised, the writer writes the electrostatic latent image on separate frames of the primary imaging member so that variable amounts of toner would be present on each frame, thereby allowing the height of the image to be altered. Alternatively, control of the height of the image can be varied using a multibit writer so that the electrostatic latent image formed on a given frame of the primary imaging member varies, thereby creating variable density.

For example, the transport belt 210 moves the receiver member 200 with the multi-colored image to fusing assembly 30. Fusing assembly 30 includes a heated fusing roller 31 and an opposing pressure roller 32 that form a fusing nip therebetween to apply heat and pressure to a receiver member 200. The fusing assembly also applies fusing oil such as silicone oil to the fusing roller 31 depending on the application. Additional details of the developing and fusing process are described in U.S. Patent Publication No. 2008/0159786, which is incorporated by reference as if fully set forth herein.

In this embodiment, the same transport belt 210 is used for transferring the receiver members 200 through the printing modules and for moving the receiver members 200 through the fusing step so that the process speed for fusing and the process speed for applying raised and print images are the same. Alternatively, separate transport mechanisms can be provided for applying images and fusing images allowing the image applying and fusing process speeds to be set independently.

The term particle size, as used above, refers to developer and carrier, as particles as well as marking and non-marking particles. The mean volume weighted diameter is measured by conventional diameter measuring devices, such as a Coulter Multisizer, sold by Coulter, Inc. and the mean volume weighted diameter is the sum of the mass of each particle times the diameter of a spherical particle of equal mass and density, divided by total particle mass. In order to provide a tactile feel it is desirable to achieve a post fusing stack height of at least 20 μm on a receiver member. However, 40 to 50 μm and greater stack heights are often desirable for some applications, and in some cases even greater stack heights including heights of 100 μm and more are required. The print image can be a multi-colored print image formed by using a plurality of electrographic print modules, as shown in FIG. 2, by using electrographic print engine 100, electrographic print module 10A to form color toner separation images, including that for the light color in the electrographic print module 10B as well as forms a magenta (M) toner separation image, or cyan (C) toner separation image, and a black (K) toner separation images. While the use of C, Y, M, and K images allows generation of a print image having a spectrum of colors the invention may be practiced using other colors. The electrographic printing modules 10A, 10B, 10C, and 10D are controlled using electrographic process-set points, control parameters, and algorithms appropriate for the developer for printing using the marking particles and carrier particles of the print image. The set-points, control parameters, and algorithms can be implemented in logic forming part of the logic and control unit 123.

The electrographic printing modules 10A, 10B, 10C, and 10D are controlled using electrographic process-set points, control parameters, and algorithms appropriate for the developer for printing using the marking particles and carrier particles of the print image. The set-points, control parameters, and algorithms can be implemented in logic forming part of the logic and control unit 123.

After electrographic printing modules 10A, 10B, 10C, and 10D deliver the multi-color portion of the print image to the receiver member 200, a plurality of remaining modules can be used to form raised images on selected areas of the receiver member 200. By employing multiple printing modules to apply raised images to the receiver member in a single pass, a final stack height can be obtained for providing the required tactile feel.

Figure 3:
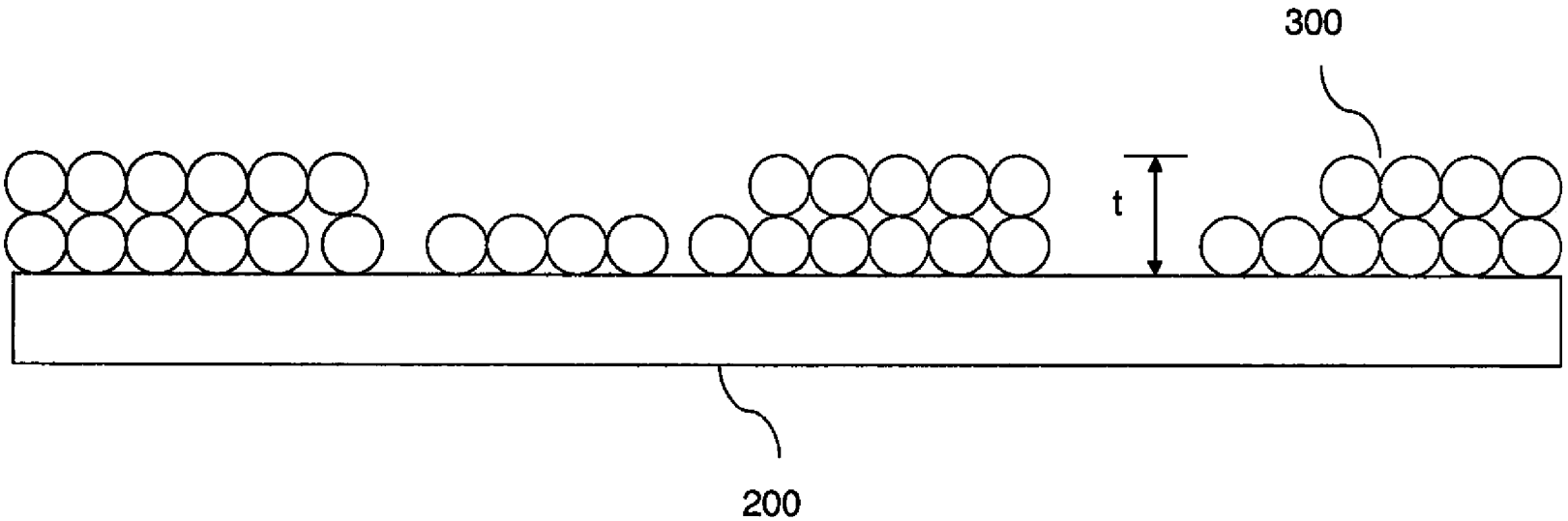
FIG. 3 is a schematic side view illustrating a cross section of a receiver member having a print image formed thereon.
Figure 4:
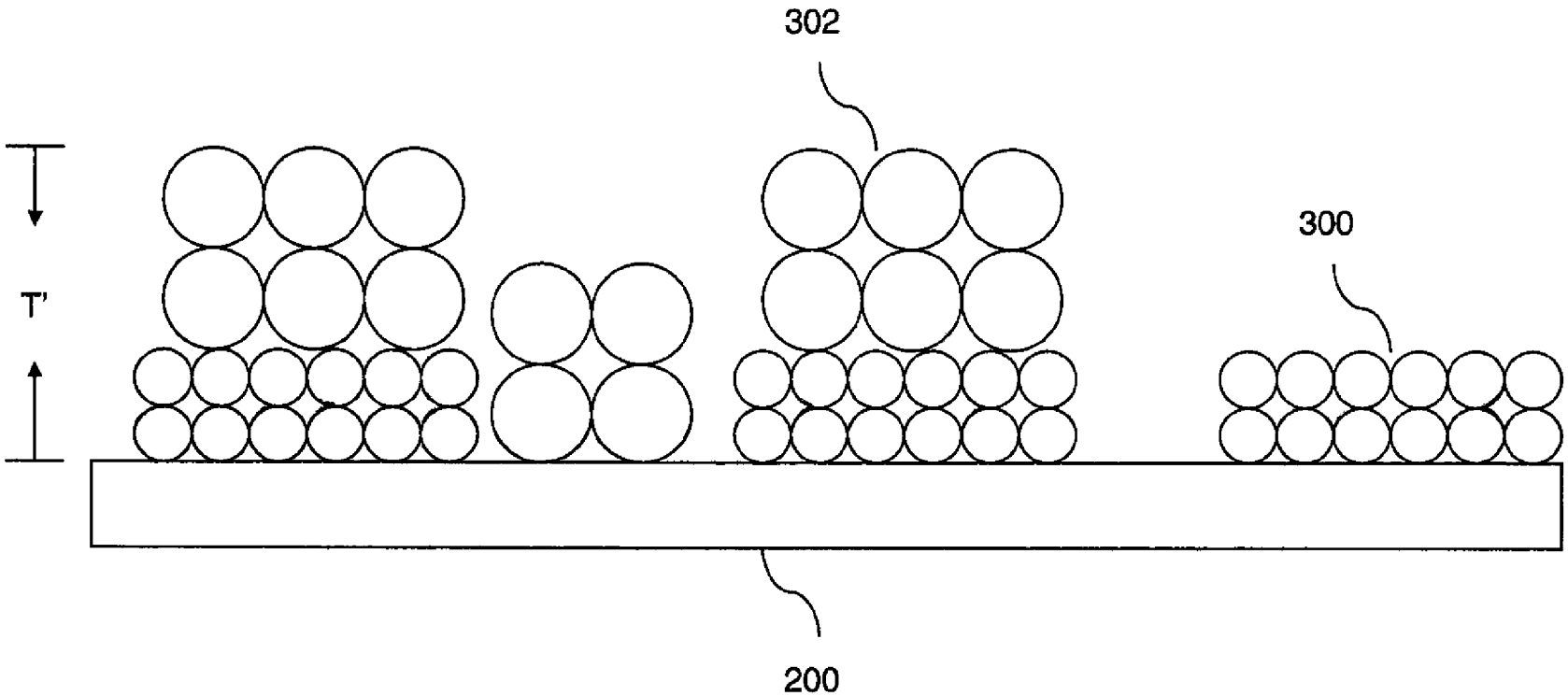
FIG. 4 is a schematic side view illustrating a cross section of a receiver member having a first raised image formed thereon.
Figure 5:
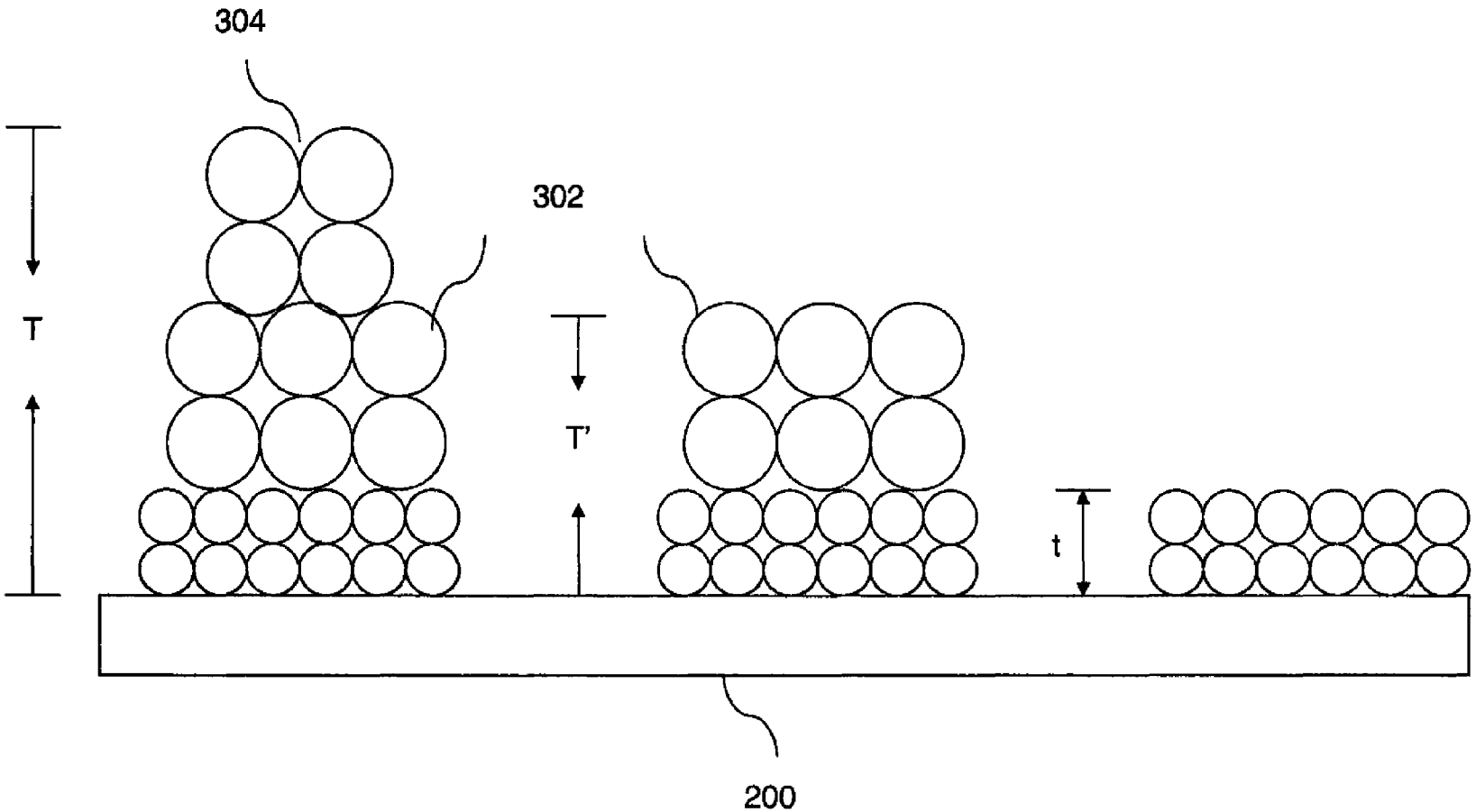
FIG. 5 is a schematic side view illustrating a cross section of a receiver member having a second raised image formed thereon.

FIG. 3 shows a receiver member 200 having a print image 300 formed using print modules 10A, 10B, 10C, and 10D. As shown in FIG. 3, the print image has a stack height "t." Where 8 μm marking particles are used, the print image stack height can be between 4 and 8 μm after the fusing process. FIG. 4 shows a receiver member 20 having a print image 302 formed where the stack height is $T^2$.

The development stations for electrographic printing modules 10E and 10F supply developer that includes carrier particles and non-pigmented non-marking particles. The non-marking particles used in forming the raised images can be comparable in size than the standard sized marking particles used in forming the print image. Using nonmarking particles can allow the stack height to be built up without significantly affecting the image density.

As mentioned, this technique can be used to tailor the relief of the image to the image. For example, a mountain seen can have texture imparted to the image that portrays the roughness of the terrain. This can be accomplished by varying the amount of toner of a specific color deposited on various passes through the print engine. Using this technique, areas such as shadowy regions can be enhanced.

In an alternative embodiment of practicing this invention, a first image consisting of one or more of the toners available in the various development stations within print engine 100 is produced on a primary imaging member, using the methods discussed above. The image is transferred to an electrically conducting substrate such as nickelized polyethylene terephthallate (PET), flex circuit material used to produce printed circuits, metallic sheets, etc. Transfer is effected using known methods such as electrically biasing either the primary imaging member or the receiver while pressing the receiver into contact with the primary imaging member so as to urge the toned image to transfer from the primary imaging member to the receiver.

After transferring the image to the receiver, the image is fixed using known methods such as by subjecting the image-bearing receiver to heat, heat and pressure, microwaves, RF radiation, or vapors from suitable organic solvents such as dichloromethane or ethylacetate.

The image-bearing receiver is then electrically charged in a polarity that would result in the toner particles in the development station being attracted to the previously toned and fused image. This is preferably accomplished by grounding the receiver and then charging the receiver using known means such as a corona charger or a roller charger. The conductive material, being grounded, would not become charged. However, the toned image, which must consist of electrically insulating toner, would retain the charge. Further toner would then be deposited onto the toned image by grounding the receiver and passing the toned receiver into close proximity to the development station, which is maintained at a potential of zero or near zero volts. It should be noted that a small offset in the potential (less than 50 volts) can be maintained on the development station so as to attract the toner to the station to prevent background. For example, if one uses negatively charged toner particles and has charged the image bearing receiver (that is the image-bearing portion of the receiver to a voltage of +500 volts, the development station can be biased at a voltage of less than +50 volts so that toner would be preferentially attracted to the development station and not be deposited onto the untoned regions of the receiver, thereby minimizing image spread.

In an alternative embodiment of this invention, the receiver and the development station can be biased rather than grounded. In this embodiment, the development station and the receiver are both biased to a potential such that the bias of the receiver differs from the bias applied to the development station by less than 50 volts so that toner is preferentially attracted to the development station rather than to the untoned regions of the receiver. For example, as is well known, positive corona chargers are more uniform than are negative chargers. Suppose one wishes to practice the present embodiment of this invention with positively charged toners. One could create an electrostatic latent image, render the electrostatic latent image visible, transfer the visible toned image to an electrically conducting receiver, and fix the image using methods previously described. One could then use an AC charger having a DC offset of approximately +50 to +100 volts. The bias on the development station could be set to approximately +450 and the bias applied to the receiver could be +500 volts, thereby maintaining a difference of potential between the development station and the receiver of −50 volts. Toner would be attracted to the development station as opposed to the untoned regions of the receiver, but would be preferentially attracted to the toned regions of the receiver, thereby permitting a second toner deposit to be applied to the previously toned region. After fixing, this process can be repeated until an image of sufficient height is obtained. In this mode of practicing the invention, it is preferable that the appropriate AC or DC corona charge be incorporated into the electrophotographic engine in such a position so that the primary charger used to initially charge the NM not be used to adjust the charge on the transferred toner image. It is preferable that charge correction occur after the image has been fixed to the receiver.

In the description above, development and transfer occur using separate and distinct electrophotographic modules prints are made in a parallel mode of operation, i.e. cyan, magenta, yellow, black, and clear toner images are developed simultaneously. After each set of images has been transferred to the final receiver, it is preferable that the image be fixed to the receiver. This can be accomplished by passing the image through a pair of rollers so that heat and pressure are applied to the image-bearing receiver. Alternatively, the image can be fixed using radiant heat, microwave or RF electromagnetic radiation, solvent vapors, etc. Fixing need not be as rigorous as would be needed for final fusing wherein the image must be made abrasion resistant and all colors must be blended. Rather, it is sufficient to fix the image so that back transfer and image disruption does not significantly occur during the transfer of sequential images to the receiver. The final fusing process must, of course, meet these requirements. In order to accomplish both fixing and final fusing, it is preferable that separate fixing and final fusing systems be used, with fixing occurring prior to each repetition of the transfer process. Thus, for a five-color electrophotographic engine containing development stations for each of the subtractive primary colored toners plus a station for clear toner, the cyan, magenta, yellow, black, and clear separations would be transferred. The resulting image would then be fixed to the receiver. The process would then be repeated until sufficient relief was obtained. After the final transfer process had been completed, final fusing would be done, thereby making the image permanent, providing abrasion resistance, and blending the colors.

The process described in this invention is also suitable for practice in an electrophotographic engine using a serial process to obtain relief. For example, suppose raised letter printing were to be accomplished using an electrophotographic engine containing four or fewer development stations. Specifically, consider for example the case where the electrophotographic engine contains a single development station. The electrostatic latent image would be developed into a visible image, the visible image transferred to the receiver, the image fixed using the methods described previously, and the process repeated, transferring sequential images in register to the receiver. After sufficient relief had been obtained, the image on the receiver would be subjected to final fusing.

In one mode of practicing this invention, the use of clear toner allows image relief or raised letter printing to be accomplished without affecting overall print density. For example, suppose one wished to print a mountain scene incorporating texture but also wished to have raised printing in excess of 50 μm. By incorporating the clear or nonmarking toner, the amount of relief is made independent of the image density. Conversely, if only marking particles are used to provide relief, large amounts of relief would only occur in high density regions. Thus, this invention would be more suitable, if practiced without the use of nonmarking toner, for applications such as those where alphanumeric images requiring raised letter printing were being produced.

EXAMPLE

An electrostatic latent image consisting of a series of parallel lines spaced approximately 1 min apart from each other was formed on a primary imaging member consisting of a commercially available photoreceptor by negatively charging the photoreceptor with a grid controlled charger. The initial potential on the photoreceptor was approximately −450 volts. The charged photoreceptor was then exposed to light to substantially discharge the photoreceptor in a pattern corresponding to the lines while leaving the unexposed regions at the initial potential. The image was then developed using a commercially available negatively charged polyester toner having a median volume weighted diameter of approximately 8 μm, while biasing the development station to a potential of approximately −350 volts. This resulted in toner being deposited into the discharged areas of the photoreceptor. The image was then transferred to a clay-coated paper (Lustro Offset Enamel) by wrapping the paper around a biased transfer roller that was biased to a potential of +1,000 volts and using the roller to press the receiver against the photoreceptor. After transferring the image to the receiver, the receiver was removed from the transfer roller and exposed to vapors of dichloromethane to fix the image. After fixing, the receiver was replaced on the transfer roller so that a subsequent, identical image could formed and transferred in register with the first. The above process was repeated approximately half a dozen times, resulting in an image having raised lines of approximately half a millimeter in height and having the texture of corduroy.

The invention has been described in detail with particular reference to certain preferred embodiments thereof, but it will be understood that variations and modifications can be effected within the spirit and scope of the invention.

What is claimed is:

1. A method of producing prints having textured content comprising:

a. charging a primary imaging member;

b. forming an electrostatic latent image on the primary imaging member;

c. depositing toner particles to render the electrostatic latent image visible;

d. transferring the toned image to a receiver e. fixing the toned image;

f. repeating steps a-c at least one more time, wherein the toned image contains some identical content to the previously developed and fixed image, and the identical content corresponds to at least a portion of the toned image that is to be raised relative to other portions of the toned image;

g. transferring the toned image to the receiver in register with the previous image;

h. fixing the toned image;

i. charging the fixed toned image on the receiver;

j. causing untoned portions of the receiver to have a charge that is different than the charge on the fixed toned image; and k. further developing the receiver and fixed toned image with further toner particles using the difference between the charge on the fixed toned image and the receiver to result in the further toner particles being attracted to the fixed toned image to obtain a fixed toned image with raised portions.

2. The method of claim 1 wherein the primary imaging member is a photoreceptive member.

3. The method of claim 1 wherein the image is fixed by subjecting the image to heat.

4. The method of claim 1 wherein the image is fixed by subjecting the image to solvent vapors.

5. The method of claim 1 wherein the charge on the fixed image is neutralized prior to transferring a sequential image.

6. A method of producing prints having textured content comprising:

a. charging a primary imaging member;

b. forming an electrostatic latent image on the primary imaging member and rendering the electrostatic image visible by depositing toner particles to form the toned image;

c. transferring the toned image to an electrically conductive receiver;

d. fixing the toned image;

e. charging the image bearing receiver with a polarity opposite that of the toner particles;

f. bringing the image-bearing receiver into close proximity with a development station and depositing additional toner particles on the fixed toner image to form a fixed toned image with the additional toner particles thereon;

g. fixing the toned image with the additional toner particles thereon;

h. charging the fixed toned image with the additional toner particles thereon on the receiver;

i. causing untoned portions of the receiver to have a charge that is different than the charge on the fixed toned image with the additional toner particles thereon; and j. further developing the receiver and fixed toned image with the additional toner particles thereon with further toner particles using the difference between the charge on the fixed toned image with the additional toner particles thereon and the receiver to result in the further toner particles being attracted to the fixed toner image with the additional toner particles thereon to obtain a fixed toned image with raised portions.

7. The method of claim 6 whereby steps e-g are repeated at least one time.

8. The method of claim 6 whereby the receiver is grounded.

9. The method of claim 6 whereby the steps b-f are repeated at least one time.

10. The method of claim 6 whereby the steps e-f are repeated at least one time.

11. A method of producing prints having textured content comprising:

a. charging a primary imaging member;

b. forming an electrostatic latent image on the primary imaging member and rendering the electrostatic image visible by depositing toner particles thereon to form a toned image;

c. transferring the toned image to a receiver;

d. fixing the toned image;

e. charging the fixed toned image on the receiver;

f. causing untoned portions of the receiver to have a charge that is different than the charge on the fixed toned image; and g. further developing the receiver and fixed toned image with further toner particles using the difference between the charge on the fixed toned image and the receiver to result in the further toner particles being attracted to the fixed toned image to obtain a fixed toned image with raised portions.

12. A method of producing prints having textured content comprising:

a. charging a primary imaging member;

b. forming an electrostatic latent image on the primary imaging member;

c. depositing toner particles to render the electrostatic latent image visible;

d. transferring the toned image to a receiver e. fixing the toned image;

f. repeating steps a-e at least one more time, wherein the toned image contains some identical content to the previously developed and fixed image, the identical content corresponds to at least a portion of the toned image that is to be raised relative to other portions of the toned image, and the toned image is transferred to the receiver in register with the previous image;

g. charging the fixed toned image on the receiver;

h. causing untoned portions of the receiver to have a charge that is different than the charge on the fixed toned image; and i. further developing the receiver and fixed toned image with further toner particles using the difference between the charge on the fixed toned image and the receiver to result in the further toner particles being attracted to the fixed toned image to obtain a fixed toned image with raised portions.

* * * * *